US008118890B2

(12) United States Patent
Schingnitz et al.

(10) Patent No.: US 8,118,890 B2
(45) Date of Patent: Feb. 21, 2012

(54) METHOD AND DEVICE FOR PRODUCING SYNTHESIS GASES BY PARTIAL OXIDATION OF SLURRIES PREPARED FROM FUELS CONTAINING ASH AND FULL QUENCHING OF THE CRUDE GAS

(75) Inventors: Manfred Schingnitz, Freiberg (DE); Bernd Holle, Freiberg (DE); Norbert Fischer, Lichtenberg (DE)

(73) Assignee: Siemens Aktiengesellschaft, München (DE)

( * ) Notice: Subject to any disclaimer, the term of this patent is extended or adjusted under 35 U.S.C. 154(b) by 1578 days.

(21) Appl. No.: 11/355,761

(22) Filed: Feb. 16, 2006

(65) Prior Publication Data

US 2007/0062117 A1 Mar. 22, 2007

(30) Foreign Application Priority Data

Sep. 9, 2005 (DE) ..... 10 2005 043 213

(51) Int. Cl.

| | |
|---|---|
| ***B01J 7/00*** | (2006.01) |
| ***H01M 8/06*** | (2006.01) |
| ***C01B 3/36*** | (2006.01) |
| ***C01B 6/24*** | (2006.01) |
| ***C01B 3/02*** | (2006.01) |
| ***C10J 3/46*** | (2006.01) |

(52) U.S. Cl. ..... 48/61; 48/197 R; 423/644; 423/648.1

(58) Field of Classification Search ..... 48/61
See application file for complete search history.

(56) References Cited

U.S. PATENT DOCUMENTS

| | | | | |
|---|---|---|---|---|
| 4,243,509 | A * | 1/1981 | Sinor | 208/408 |
| 4,502,868 | A | 3/1985 | Yaghmaie et al. | |
| 4,781,731 | A * | 11/1988 | Schlinger | 48/197 R |
| 4,848,982 | A * | 7/1989 | Tolle et al. | 48/69 |
| 5,968,212 | A * | 10/1999 | Peise et al. | 48/101 |
| 2003/0089288 | A1 * | 5/2003 | Abrams | 110/233 |
| 2004/0170210 | A1 * | 9/2004 | Do et al. | 373/118 |

FOREIGN PATENT DOCUMENTS

CN 200 4200 200 7.1 6/2004

(Continued)

OTHER PUBLICATIONS

J. Carl, P. Fritz, NOELL-KONVERSIONSVERFAHREN, EF-Verlag für Energie-und Umwelttechnik GmbH, 1996, p. 33 and p. 73. C. Higman and M. van der Burgt, "Gasification", Verlag Elsevier, USA, 2003.

Born et al., "Vergasungsvergahren für die Entsorgung von Abfällen," Springer Verlag, 1998, pp. 132-153. (German OA).

*Primary Examiner* — Matthew Merkling
(74) *Attorney, Agent, or Firm* — Collard & Roe, P.C.

(57) ABSTRACT

A method and device for the gasification of solid fuels such as bituminous coals, and cokes such as those from bituminous coals, lignite coals, and biomasses, as well as petroleum cokes, that are ground fine and mixed with water or oil to obtain fuel-in-liquid suspensions, so-called slurries, and their gasification together with an oxidizing medium containing free oxygen, by partial oxidation at pressures between atmospheric pressure and 100 bar, and at temperatures between 1200 and 1900° C. in an entrained flow reactor. The method includes slurry preparation and infeed to the reactor, gasification in an entrained flow reactor with cooled reaction chamber contour, full quenching of the crude gas to saturation temperature that may be 180-260° C. depending on the gasification pressure, and wet or dry dust separation. The crude gas is pretreated so that it can be fed to further technological steps such as crude gas conversion, $H_2S$ and $CO_2$ removal, and synthesis.

6 Claims, 2 Drawing Sheets

FOREIGN PATENT DOCUMENTS

| | | | |
|---|---|---|---|
| CN | 2700718 | | 5/2005 |
| DE | 197 131 | A1 | 10/1905 |
| DE | 35 34 015 | | 4/1986 |
| DE | 42 41 283 | | 6/1994 |
| DE | 44 46 803 | | 6/1996 |
| DE | 10 2005 041 9 | | 3/2007 |
| EP | 0 191 964 | | 8/1986 |
| EP | 0 677 567 | | 9/1997 |
| GB | 2004993 | A * | 4/1979 |
| WO | WO 96/17904 | | 6/1996 |

* cited by examiner

METHOD AND DEVICE FOR PRODUCING SYNTHESIS GASES BY PARTIAL OXIDATION OF SLURRIES PREPARED FROM FUELS CONTAINING ASH AND FULL QUENCHING OF THE CRUDE GAS

BACKGROUND OF THE INVENTION

1. Field of the Invention

This invention relates to a gasification method comprising the process steps of slurry preparation, slurry infeed, gasification reaction, full quenching, gas scrubbing, and partial condensation, wherein the gas scrubbing and partial condensation can be replaced by mechanical dust separation, to produce gases containing CO and $H_2$ by partial oxidation with a gasification medium containing free oxygen at high temperatures and elevated pressure.

To achieve long operating times, the pressurized jacket of the gasification reactor has to be protected reliably against the action of crude gas and against the high gasification temperatures of 1,200° C.-1,900° C. This is accomplished by confining the reaction or gasification chamber with a cooled tubular shield that is hung in the pressurized jacket. The annular gap between tubular shield and pressurized jacket is flushed.

The fuel is brought to the gasification chamber as a slurry by pump transport, and is fed through burners to the head of the reactor. One or more fuels or varieties of coal can be gasified as a slurry at the same time. The crude gas leaves the gasification chamber together with the liquefied slag at the bottom of the reactor and is then partially cooled, to a saturation temperature of 180° C. to 260° C. that depends on the process pressure, by injecting water, and after a wet or dry dust separation, it is sent for further treatment steps such as crude gas conversion or desulfurization.

2. The Prior Art

The autothermic entrained flow gasification of solid, liquid, and gaseous fuels has been known in the technology of gas production for years. The ratio of fuel to gasification medium containing oxygen is chosen so that higher carbon compounds are completely cracked for quality reasons into synthesis gas components such as CO and $H_2$, and the inorganic components are discharged as molten slag; see J. Carl, P. Fritz, NOELL-KONVERSIONSVERFAHREN, EF-Verlag für Energie- und Umwelttechnik GmbH, 1996, p. 33 and p. 73.

According to various systems used in industry, gasification gas and molten slag can be discharged separately or together from the reaction chamber of the gasification device, as shown in German Patent No. DE 197 131 A1. Either systems with refractory linings or cooled systems are used for the internal confinement of the reaction chamber structure of the gasification system; see German Patent No. DE 4446 803 A1.

European Patent No. EP 0677 567 B1 and International Publication No. WO 96/17904 show a method in which the gasification chamber is confined by a refractory lining. This has the drawback that the refractory masonry is loosened by the liquid slag formed during gasification, which leads to rapid wear and high repair costs. This wear process increases with increasing ash content. Thus, such gasification systems have a limited service life before replacing the lining. Also, the gasification temperature and the ash content of the fuel are limited. Feeding in the fuel as a coal-water slurry causes considerable losses of efficiency, see C. Higman and M. van der Burgt, "Gasification", Verlag ELSEVIER, USA, 2003, which can be reduced or prevented by using oil as the carrier medium or by preheating the coal-water slurry. The simplicity of the infeed system is advantageous. A quenching or cooling system is also described, with which the hot gasification gas and the liquid slag are carried off together through a conduit that begins at the bottom of the reaction chamber, and are fed into a water bath. This joint discharge of gasification gas and slag can lead to plugging of the conduit and thus to limitation of availability.

German Patent No. DE 3534015 A1 shows a method in which the gasification media, powdered coal and oxidizing medium containing oxygen, are introduced into the reaction chamber through multiple burners in such a way that the flames are mutually deflected. The gasification gas loaded with powdered dust flows upward and the slag flows downward into a slag-cooling system. As a rule, there is a device above the gasification chamber for indirect cooling utilizing the waste heat. However, because of entrained liquid slag particles, there is the danger of deposition and coating of heat exchanger surfaces, which hinders heat transfer and may lead to plugging of the pipe system and/or erosion. The danger of plugging is counteracted by taking away the hot crude gas with a circulated cooling gas.

Ch. Higman and M. van der Burgt in "Gasification", page 124, Verlag Elsevier 2003, describe a method in which the hot gasification gas leaves the gasifier together with the liquid slag and directly enters a waste heat boiler positioned perpendicularly below it, in which the crude gas and the slag are cooled with utilization of the waste heat to produce steam. The slag is collected in a water bath, while the cooled crude gas leaves the waste heat boiler from the side. A series of drawbacks detract from the advantage of waste heat recovery by this system. One particular drawback is the formation of deposits on the heat exchanger tubes, which lead to hindrance of heat transfer and to corrosion and erosion, and thus to lack of availability.

Chinese Patent No. CN 200 4200 200 7.1 describes a "Solid Pulverized Fuel Gasifier", in which the powdered coal is fed in pneumatically and gasification gas and liquefied slag are introduced into a water bath through a central pipe for further cooling. This central discharge in the central pipe is susceptible to plugging that interferes with the overall operation, and reduces the availability of the entire system.

SUMMARY OF THE INVENTION

It is therefore an object of the invention to provide a method for gasification that takes into account the different ash contents of fuels and has high availability, with reliable operation.

This object is accomplished by a gasification method for the gasification of solid fuels containing ash with an oxidizing medium containing oxygen, in a gasification chamber designed as an entrained flow reactor, at pressures between atmospheric pressure and 100 bar, with the reaction chamber contour confined by a cooling system, with the pressure in the cooling system always being kept higher than the pressure in the reaction chamber. The method is distinguished by the following features:

The fuel, e.g. bituminous coal, bituminous coke, lignite coke, biomass coke, and/or petroleum coke, or mixtures thereof, is dried and pulverized to a grain size of <500 μm, preferably <200 μm, and is mixed with added water or oil to form a fuel-in-water or a fuel-in-oil suspension, a so-called slurry. When water is used, a stable solids concentration of up to 70 wt. % is achieved by adding surfactants. These are brought to the desired gasification pressure of up to a maximum of 100 bar by means of suitable pumps, and are fed through suitable burners attached to the head of the gasification reactor for the gasification reaction. The fuel concentration in the slurry and the amount of flowing slurry are monitored, measured, and regulated by measurement and control devices and by monitors. An oxidizing medium containing free oxygen is fed to the burner at the same time, and the fuel slurry is converted to a crude synthesis gas by partial oxidation. The gasification takes place at temperatures between 1,200 and 1,900° C. at pressures up to 100 bar. The reactor is equipped with a cooling shield that consists of water-cooled tubes welded gas-tight.

The hot crude synthesis gas leaves the gasification reactor together with the liquid slag formed from the fuel ash, and arrives at a quenching chamber perpendicularly under it, in which the gas is cooled to the condensation point, at which it is saturated with steam, by injecting water. This saturation temperature is 180° C.-260° C., depending on the pressure. At the same time, the slag is converted to granular form. The quenching chamber is designed as an open space with no internals, in order to avoid deposition of slag or of dust entrained by the crude gas. The quenching water is introduced into the quenching chamber through nozzles that are placed directly on the jacket. The granulated slag together with the excess water is taken out of the quenching chamber through a slag discharge and is depressurized. There can be one or more slag discharges. The crude gas saturated with steam, which leaves the quenching chamber from the side at 180-260° C., is then relieved of its entrained dust. There can be one or more gas outlets. For this purpose, the crude gas is first sent to a crude gas scrubber operated at process pressure, which is preferably a Venturi scrubber. The entrained dust is thereby removed down to a particle size of about 20 μm. This degree of purity is still inadequate for carrying out subsequent catalytic processes, for example crude gas conversion. Salt mists are also entrained in the crude gas, which have detached from the powdered fuel during gasification and are carried off with the crude gas. To remove both the fine dust <20 μm and the salt mists, the scrubbed crude gas is fed to a condensation step in which the crude gas is chilled indirectly by 5° C. to 10° C. Water is thereby condensed from the crude gas saturated with steam, which takes up the described fine dust and salt particles. The condensed water containing the dust and salt particles is separated in a following separator. The crude gas purified in this way can then be fed directly, for example, to a crude gas converter or to a desulfurization system.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT 320 tons/hour of bituminous coal with a composition of

Figure 1:
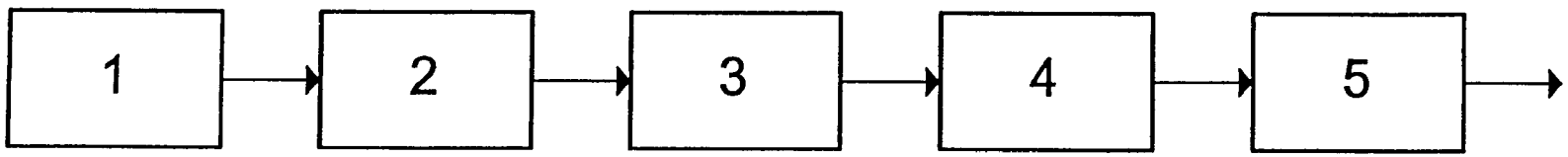
FIG. 1 shows a block diagram of the proposed method.
Figure 2:
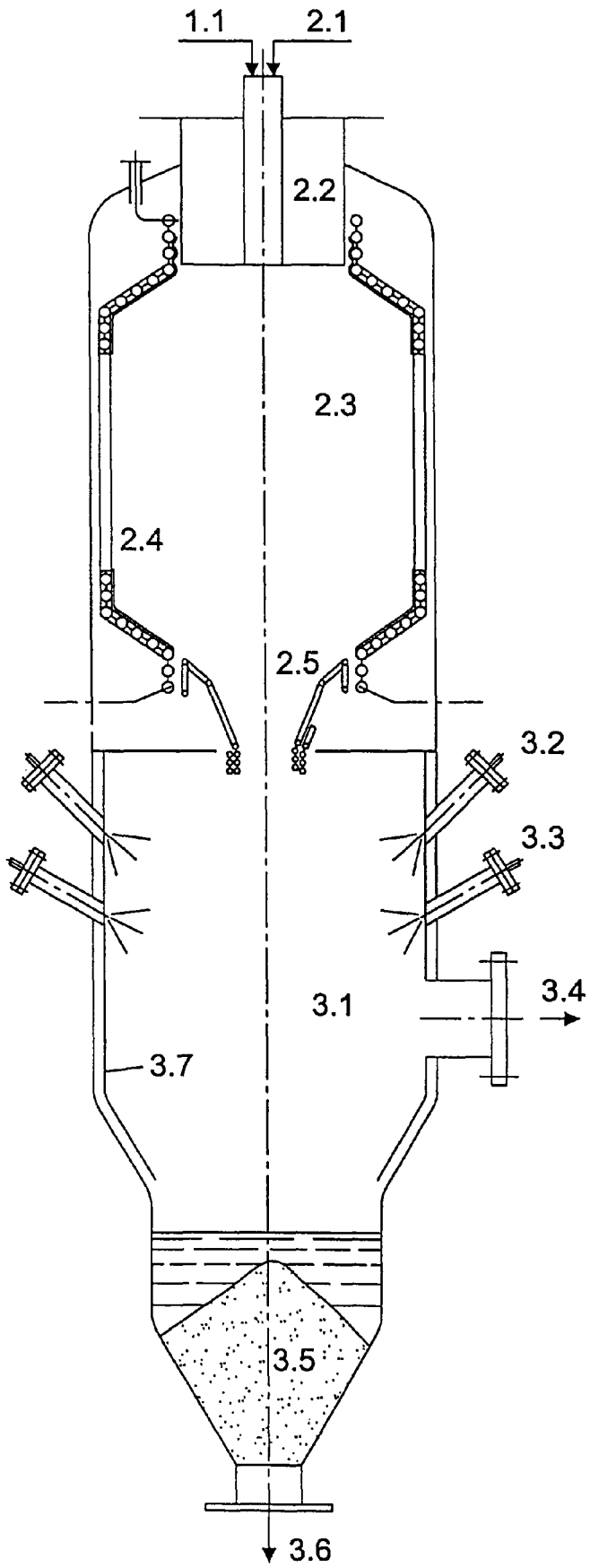
FIG. 2 shows a gasification reactor with quenching cooler according to one embodiment of the invention.

| | |
|---|---|
| C | 71.5 wt. % |
| H | 4.2 wt. % |
| O | 9.1 wt. % |
| N | 0.7 wt. % |
| S | 1.5 wt. % |
| Cl | 0.03 wt. %, |

an ash content of 11.5 wt. %, and a moisture content of 7.8 wt. %, is to be gasified at a pressure of 40 bar. The calorific value of the coal is 25,600 kJ/kg. The gasification takes place at 1,450° C. 245,000 $m^3$ i. N./h of oxygen is needed for the gasification. The coal is first fed to a state-of-the-art grinder in which it is pulverized to a grain size range between 0 and 200 μm, and it is then mixed in a special process step (FIG. 1) with water and added surfactants to form a stable pulverized coal-in-water suspension, the so-called slurry. The solids concentration in this slurry is 63 wt. %, and the amount of slurry is 465 tons/hour. The slurry is brought to the desired gasification pressure of up to 100 bar by means of a pump suitable for transporting solid-in-liquid suspensions, and is fed through the transport line 1.1 to the burner of the gasification reactor 2, with the amount being monitored, measured, and regulated. To conserve oxygen, the slurry can be preheated to a maximum temperature of 400° C., depending on the gasification pressure, before it is fed to the gasification reactor 2. The gasification reactor is shown in FIG. 2. The slurry flowing through the transport line 1.1. to the gasification reactor 2 in an amount of 465 tons/hour, together with the 245,000 $m^3$ i.N./h of oxygen flowing in through the line 2.1, is subjected to partial oxidation at 1450° C., whereby 565,000 $m^3$ i.N./h of crude gas is formed with the following composition:

| | |
|---|---|
| $H_2$ | 18.5 vol. % |
| CO | 70.5 vol. % |
| $CO_2$ | 6.1 vol. % |
| $N_2$ | 2.3 vol. % |
| $NH_3$ | 0.003 vol. % |
| HCN | 0.002 vol. % |
| $H_2S$ | 0.5 vol. % |
| COS | 0.07 vol. %. |

The gasification chamber 2.3 is confined by a cooling shield 2.4 that consists of a water-cooled tube system welded gas-tight. The crude gas together with the liquid slag flows through the outlet opening 2.5 into the quenching cooler 3. The quenching cooler 3 solidly joined to the gasification reactor 2 is shown in FIG. 2. It consists of a quenching chamber 3.1 configured as an open space with no internals, into which water is sprayed through one or more rows of nozzles 3.2 and 3.3 to cool the hot crude gas. To conserve fresh water, condensate that is formed during the cooling of the crude gas in following system components is usually used for this purpose. The amount of quenching water is about 500 $m^3$/h. The crude gas saturated at 217° C. has a steam fraction of 57 vol.% at the discharge 3.4 from the quenching chamber. The slag is collected in a water bath 3.5 at the bottom of the quenching tank and is periodically discharged through the outflow 3.6. A wear jacket 3.7 is provided to protect the pressurized jacket against erosion and corrosion.

The crude gas leaving the quenching chamber 3.1 through the outlet 3.4 is then sent to the crude gas scrubber 4, which is an adjustable Venturi scrubber and is supplied with about 100 $m^3$/h of wash water. The wash water is relieved of absorbed solids in the usual way, and is sent again to the Venturi scrubber. To remove fine dust <20 μm and salt mists not separated in the Venturi scrubber, the water-scrubbed crude gas is subjected to partial condensation 5, and is cooled indirectly from 217° C. to 211° C. The finest dust and salt particles are taken up by the steam condensing out during the cooling, and are removed from the crude gas with it. The crude gas scrubbing 4 and the partial condensation 5 for dust removal can be replaced by a wet or dry separation stage, in which the crude gas leaving the quenching chamber 3.1 is sent to a mechanical cleansing stage, for example a centrifugal separator.

The crude gas cleansed of solids then has the following composition:

| | |
|---|---|
| $H_2$ | 9.5 vol. % |
| CO | 31.2 vol. % |
| $CO_2$ | 2.6 vol. % |
| $N_2$ | 1.1 vol. % |
| $NH_3$ | 0.001 vol. % |
| HCN | 0.001 vol. % |
| $H_2S$ | 0.200 vol. % |
| COS | 0.03 vol. % |
| $H_2O$ | 54.60 vol. % |

The purified, wet crude gas amounts to 1,320,000 $m^3$ NTP/hour. It can be directly sent to a crude gas converter or to other treatment steps.

Accordingly, while only a few embodiments of the present invention have been shown and described, it is obvious that many changes and modifications may be made thereunto without departing from the spirit and scope of the invention.

| List of reference symbols used | |
|---|---|
| 1 | Slurry preparation and transport |
| 1.1 | Slurry infeed |
| 2 | Reactor |
| 2.1 | Line for oxygen |
| 2.2 | Burner |
| 2.3 | Gasification chamber |
| 2.4 | Cooling shield |
| 2.5 | Discharge opening |
| 3 | Quenching cooler or cooler |
| 3.1 | Quenching chamber |

-continued

| List of reference symbols used | |
|---|---|
| 3.2 | Nozzle into 3 |
| 3.3 | Nozzle into 3 |
| 3.4 | Outlet from 3.1 |
| 3.5 | Water bath |
| 3.6 | Outflow |
| 3.7 | Wear jacket |
| 4 | Crude gas scrubber |
| 5 | Partial condensation |

What is claimed is:

1. A device for the gasification of solid fuels such as bituminous coals and cokes such as bituminous or lignite coke, biomass coke, and petroleum coke in the entrained flow with an oxidizing medium containing free oxygen, comprising:

a system for preparing and feeding slurry made from slurry fuel with a grain size of <200 μm, water and added surfactant, such that the slurry has a solids concentration of 40-70 wt %;

a reactor for the gasification of supplied powdered fuel with an oxidizing medium containing free oxygen, said reactor operating at a pressure between atmospheric pressure and 100 bar and at a temperature between 1200 and 1900° C. and comprising a supply pipe for slurried fuel received from said system and a line for the oxidizing medium, which is fed by burners into a reaction chamber having a cooling shield consisting of water-cooled pipes welded gas-tight and an outlet device;

a quenching cooler with no internals, said quenching cooler being connected to the reactor and having nozzles arranged in one or more nozzle rings through which is sprayed water for quenching, said nozzles being flush with an inner jacket; and a gas cleanser comprising a crude gas scrubber and partial condenser, or a device for dry dust separation, connected to the quenching cooler.

2. A device pursuant to claim 1, wherein there is an opening in the quenching cooler for the crude gas, and an opening for slag with a water bath.

3. A device pursuant to claim 1, wherein there are a crude gas scrubber and a partial condenser as the gas cleanser.

4. A device pursuant to claim 3, wherein the crude gas scrubber comprises a single- or multiple-stage Venturi scrubber.

5. A device pursuant to claim 1, wherein the gas cleanser is a mechanical dry dust separator.

6. A device pursuant to claim 1, further comprising a crude gas converter or a desulfurization system following the gas cleanser.

* * * * *

UNITED STATES PATENT AND TRADEMARK OFFICE

CERTIFICATE OF CORRECTION

PATENT NO. : 8,118,890 B2
APPLICATION NO. : 11/355761
DATED : February 21, 2012
INVENTOR(S) : Schingnitz et al.

It is certified that error appears in the above-identified patent and that said Letters Patent is hereby corrected as shown below:

Title page, column 1, Item [30], please change the Foreign Application Priority Data to correctly read: -- Sep. 9, 2005 (DE) .....10 2005 043 212 --.

Signed and Sealed this
Seventeenth Day of April, 2012

David J. Kappos

David J. Kappos
*Director of the United States Patent and Trademark Office*